United States Patent [19]

Marcotte

[11] Patent Number: 4,483,354

[45] Date of Patent: Nov. 20, 1984

[54] METHOD OF COLORING HAIR

[76] Inventor: Bernadine A. Marcotte, 10515 Prouty Rd., Painesville, Ohio 44077

[21] Appl. No.: 536,199

[22] Filed: Sep. 27, 1983

Related U.S. Application Data

[63] Continuation-in-part of Ser. No. 418,754, Sep. 16, 1982, Pat. No. 4,414,991.

[51] Int. Cl.[3] ..... A45D 24/36

[52] U.S. Cl. ..... 132/45 R

[58] Field of Search ..... 132/45 R

[56] References Cited

U.S. PATENT DOCUMENTS 459,012 9/1891 Marsh ..... 132/45 R
2,698,018 12/1954 Post ..... 132/45 R
2,722,940 11/1955 Bohannon ..... 132/45
3,000,384 9/1961 Piers, Jr. ..... 128/DIG. 15
4,414,991 11/1983 Marcotte ..... 132/45 R

*Primary Examiner*—Gregory E. McNeill
*Attorney, Agent, or Firm*—Yount & Tarolli

[57] ABSTRACT

An improved method of applying color to hair includes gripping the hair between a pair of panels having nonlinear edges. While the hair is gripped between the panels, a hair coloring agent is applied to the portion of the hair extending outwardly from the nonlinear edges on the panels. Heat is applied to the hair to expedite the coloring of the hair. The panels are then moved outwardly along the hair and the hair is cut along the nonlinear edges of the panels.

8 Claims, 7 Drawing Figures

METHOD OF COLORING HAIR

RELATED APPLICATION

This application is a continuation-in-part of application Ser. No. 418,754, filed Sept. 16, 1982 now U.S. Pat. No. 4,414,991 by Bernadine A. Marcotte for "Apparatus for Use in Cutting Hair". The benefit of the filing date of the earlier filed application is claimed under the provisions of 35 USC 120.

BACKGROUND OF THE INVENTION

The present invention relates to a new and improved method for styling hair and more specifically to a new and improved method of coloring hair.

Hair coloring agents have previously been used to either lighten or darken the color of a person's hair. These hair coloring agents have been used to bleach or dye the hair to obtain various hair styling effects. Coloring agents have been applied to the tips of strands of hair to frost the hair. In addition, the coloring agents have been applied in many different ways to the hair to tint or rinse the hair. Hair coloring is frequently done in combination with a styling process which includes cutting the hair.

SUMMARY OF THE PRESENT INVENTION

The present invention provides a new and improved method of coloring hair. In practicing the method, the hair is gripped between a pair of panels with a portion of the hair, to which a coloring agent is to be applied, extending outwardly from nonlinear edge portions of the panels. A selected one of many known hair coloring agents is then applied to the portion of the hair extending outwardly from the edge portions of the panels. The hair which is gripped between the panels is not exposed to the coloring agent so that only the portion of the hair which extends outwardly from the panels is colored.

Once the hair has been colored, the hair may be cut to a configuration corresponding to the configuration of the nonlinear edge portions of the panels. When this is to be done, the panels are moved outwardly along the hair for a selected distance. The hair is then cut along the nonlinear edge portions of the panels to have a scalloped pattern or wave which gives the hair a controlled texture. The scalloped or patterned cut makes fine hair appear fuller and bulky hair more movable.

In order to reduce the time to color and cut the hair, heat is applied to the hair immediately after it is colored. Thus, while the hair is still gripped by the panels, heat is applied to the portion of the hair which extends beyond the nonlinear edge portions of the panels and to which the coloring agent was applied. Heating the hair greatly reduces the time required for the coloring of the hair. The panels can then be moved outwardly so that the hair can be cut in the manner previously explained.

Accordingly, it is an object of this invention to provide a new and improved method of coloring hair and wherein a coloring agent is applied to hair which extends outwardly from nonlinear edge portions of a pair of panels while the hair is gripped between the panels.

Another object of this invention is to provide a new and improved method as set forth in the preceding object and wherein the hair is, after the coloring agent has been applied to the hair, cut along the nonlinear edge portions of the panels.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 3:
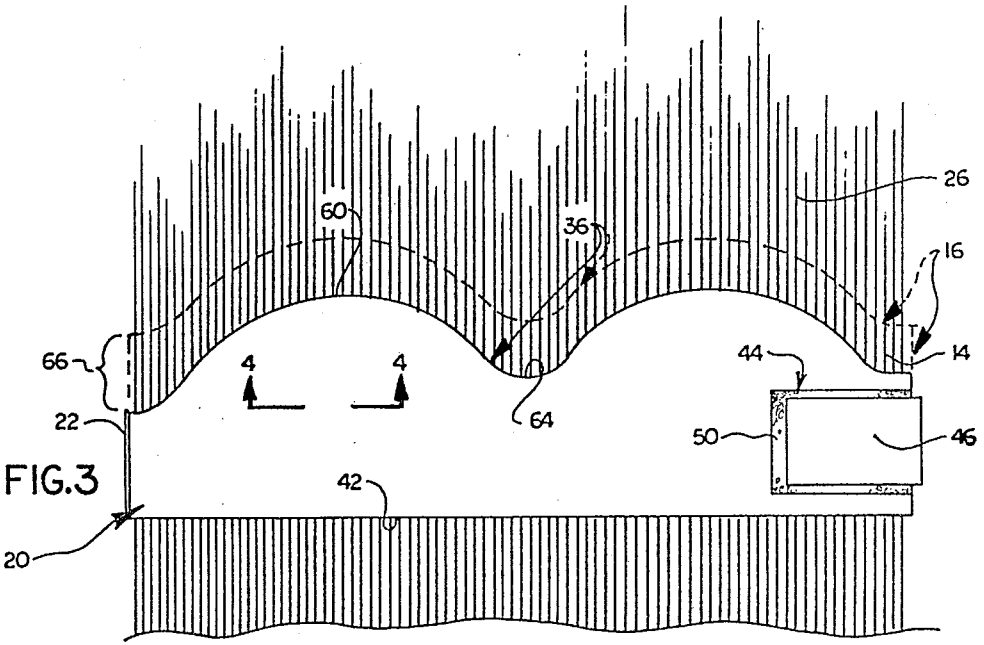
FIG. 3 is a plan view of the templet of FIG. 2 in a closed condition gripping hair to be colored and cut.

An improved hair style 10 (FIG. 1) is cut to have scalloped patterns or waves 12 with tips or ends 14 which have been colored to obtain either highlights or lowlights. Thus, the tips or ends 14 of the hair may either be lightened to provide highlights or darkened to provide lowlights. The color is applied to the tips of the hair with the same pattern which is subsequently used to cut the hair. Therefore, even though the hair is cut in an irregular or scalloped pattern, the color extends for the same distance along the ends of each strand of hair. It should be noted that the waves 12 and colored tips or ends of the hair have been schematically emphasized in FIG. 1 for purposes of clarity of illustration.

In accordance with the present invention, the hairstyle 12 is obtained by using a templet 16 (see FIGS. 2 and 3) during coloring of the hair. The templet 16 enables the tips or ends 14 of the hair to be colored in a selected nonlinear pattern, that is, a pattern which is not straight, so that the distance which the coloring starts from the scalp varies. In addition, the templet 16 may be used as a guide during cutting of the hair in a nonlinear pattern, that is a pattern which is not straight, so that the length of the hair varies.

The templet 16 includes a base panel 18 (FIG. 2) and a cover panel 20 which are pivotally interconnected at a hinge joint 22. The panels 18 and 20 are movable between the open condition of FIG. 2 and the closed condition of FIG. 3 to clamp strands of hair 26 between the two panels 18 and 20.

In the closed position of FIG. 3, major inner sides 30 and 32 (FIG. 2) of the panels 18 and 209 are disposed in a side-by-side relationship with the nonlinear pattern edge portions 34 and 36 disposed in alignment with each other (FIG. 3). This enables the pattern edge portions 34 and 36 to be used to limit the application of a coloring agent to the ends of the hair and to guide movement of a cutting instrument, such as scissors, razors or clippers, during cutting of the hair.

Figure 2:
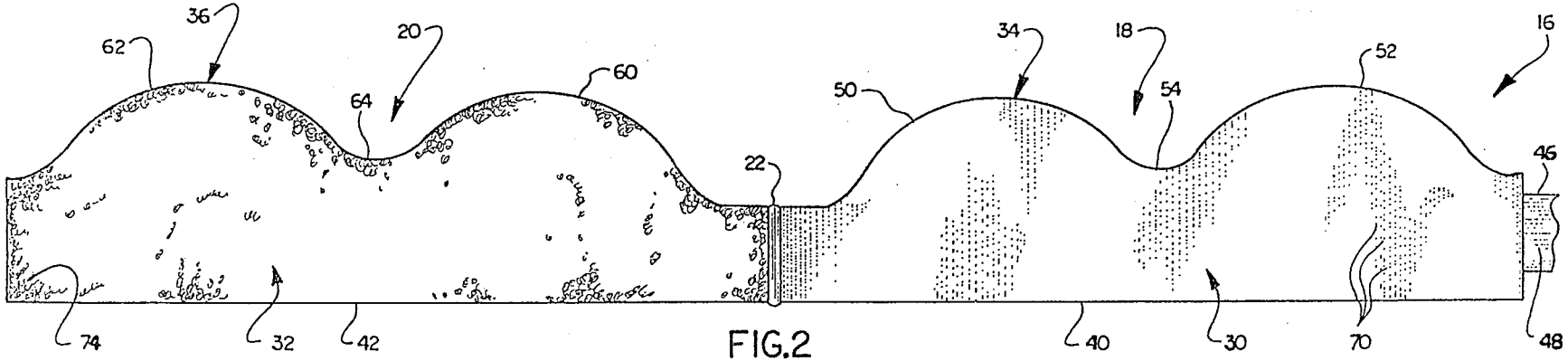
FIG. 2 is a plan view of a templet which is used to grip the hair during the coloring and cutting of the hair, the templet being shown in an open condition before hair is gripped between panels of the templet.

When the panels 18 and 20 are in the open condition of FIG. 2, the strands of hair 26 are placed on the major side 30 of the base panel 18. A cover panel 20 is then pivoted about the hinge connection 22 to press the strands of hair against the base panel 18. The free ends of the hair extend outwardly from the pattern edge portions 34 and 36 of the closed panels (FIG. 3). The portions of the hair leading to the scalp extend from linear base edge portions 40 and 42 (FIGS. 2 and 3) of the panels 18.

A fastener arrangement 44 holds the panels 18 and 20 in the closed position of FIG. 3 while a coloring agent is applied to the hair and, thereafter, while the hair is cut. While other types of fasteners could be used, in the illustrated embodiment of the templet 16, a strap 46 (FIG. 2) is connected with one end of the base panel 18. The strap 46 has an inner side surface 48 from which a plurality of bristles extend. These bristles engage a fibrous mat 50 (FIG. 3) on the base panel 20 to hold the panels in the closed condition. The strap 46 and fibrous base 50 are sold under the trademark "Velcro".

The pattern edge portions 34 and 36 have a nonlinear configuration. Thus, the pattern edge portion 34 on the base panel 18 has arcuately curving crests 50 and 52 (FIG. 2) with a trough 54 between the crests. Similarly, the pattern edge portion 36 on the cover panel 20 has arcuately curving crests 60 and 62 with a trough 64 between the crests. Although the crests and troughs 50, 52, 54, 60, 62 and 64 have a curving configuration, it is contemplated that they could have other configurations if desired. For example, the pattern edge portions 34 and 36 could be formed with crests and troughs having straight sides.

When the panels 18 and 20 are in the closed condition of FIG. 3, the crests 50 and 52 and troughs 54 on the pattern edge portion 34 are aligned with the crests 60 and 62 and trough 64 on the pattern edge portion 36. Thus, the crest 60 on the panel 20 has the same configuration as the crest 50 on the panel 18. Similarly, the crest 62 on the panel 20 has the same configuration as the crest 52 on the panel 18. The troughs 64 and 54 also have the same configuration. Therefore, when the panels 18 and 20 are moved to the closed condition shown in FIG. 3, the crests 50, 52, 60 and 62 are disposed in a side-by-side relationship and are aligned with each other. The troughs 54 and 64 are also disposed in a side-by-side relationship and are aligned with each other.

The aligned pattern edge portions 34 and 36 are formed by the minor sides of the panels 18 and 20 and provide surfaces for limiting the application of color to the strands of hair and for guiding movement of scissors or other cutting instruments along a path having the same configuration as the pattern edge portions. Thus, when a coloring agent is applied to the strands 26 of hair with the templet 16 in the closed condition of FIG. 3, the coloring agent is applied to only the portions of the strands 26 of hair which extend outwardly from the pattern edge portions 34 and 36. The coloring agent is not applied to the portions of the strands 26 of hair which are enclosed between the panels 18 and 20 of the templet and is not applied to the portions of the strands of hair extending downwardly (as viewed in FIG. 3) toward the scalp. This results in the strands 26 of hair being colored in a pattern which begins at a line having the same configuration as the pattern edge portions 34 and 36 and extends outwardly to the ends of the strands 26 of hair.

Although the hair may be cut before application of the coloring agent, it is preferred to cut the hair after it has been colored. Thus, after the strands of hair 26 have been colored, the templet 16 is moved outwardly along the strands of hair through a distance which corresponds to the length to which the tips or ends 14 of the hair is to be colored. For example, if it is desired to have the waves 12 (FIG. 1) with colored tips or ends 14 of a length indicated by the distance 66 in FIG. 3, the templet 16 is moved outwardly along the hair from the position shown in solid lines in FIG. 3 to the position shown in dashed lines in FIG. 3. It is contemplated that the distance 66 will, for certain hairstyles at least, be approximately $\frac{1}{4}$ to $\frac{1}{2}$ of an inch. Of course, the distance 66 could be any desired distance depending upon the hairstyle.

After the coloring agent has been applied to the hair with the templet 16 in the position shown in solid lines in FIG. 3 and the templet has been moved outwardly to the position shown in dashed lines in FIG. 3, a cutting instrument is moved along the pattern edge portions 34 and 36. Each of the strands 26 of hair is cut along the dashed line in FIG. 3 to a length determined by the position of the strands of hair along the patterned edge portions 34 and 36 of the panels 18 and 20. This results in the strands of hair being cut to a nonlinear pattern and being colored to the same nonlinear pattern.

Figure 4:
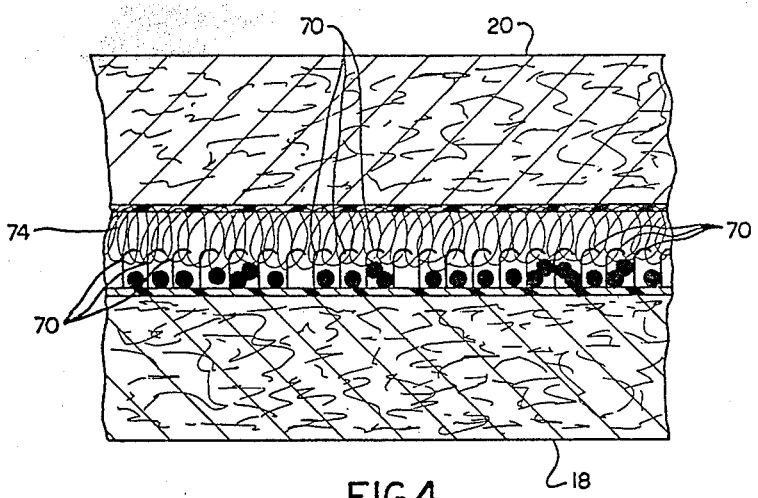
FIG. 4 is an enlarged fragmentary sectional view, taken generally along the line 4—4 of FIG. 3, illustrating the relationship between an array of bristles projecting from a panel of the templet of FIGS. 1 and 2 and a plurality of strands of hair.

In order to comb and straighten the hair and then to hold it against sidewise movement along the pattern edge portions 34 and 36, an array of bristles 70 (FIGS. 2 and 4) project from the inner side 30 of the panel 18 throughout the extent of the panel. When the templet 16 is in the open condition of FIG. 2, the strands 26 of hair are laid over the bristles on the base panel 18. The cover panel 20 is then closed against the base panel 18. This results in the hair being trapped between the bristles 70 and gripped between the two panels 18 and 20.

The closed templet 12 is then moved away from the head of a person whose hair is being cut. This pulls the hair taut between the templet 16 and the scalp to comb the hair. The bristles 70 keep the hair from moving sideways and bunching up at various locations along the pattern edge portions 34 and 36.

In order to prevent the bristles 70 from being flattened and deflected by the cover panel 20, a fibrous mat 74 (FIGS. 2 and 4) forms the major side 32 of the cover panel 20. The free ends of bristles 70 project into the fribrous mat 74 when the panels 18 and 20 are in the closed condition of FIG. 3. Therefore, the filaments in the fibrous mat 74 press the strands of hair against the base panel 18 (see FIG. 4).

The base panel 18 and cover panel 20 may be formed of a relatively stiff plastic or fiberboard material. The bristles 70 and fibrous mat 74 are mounted on these panels. The bristles 70 and fibrous mat 74 are sold under the trademark "Velcro".

Figure 1:
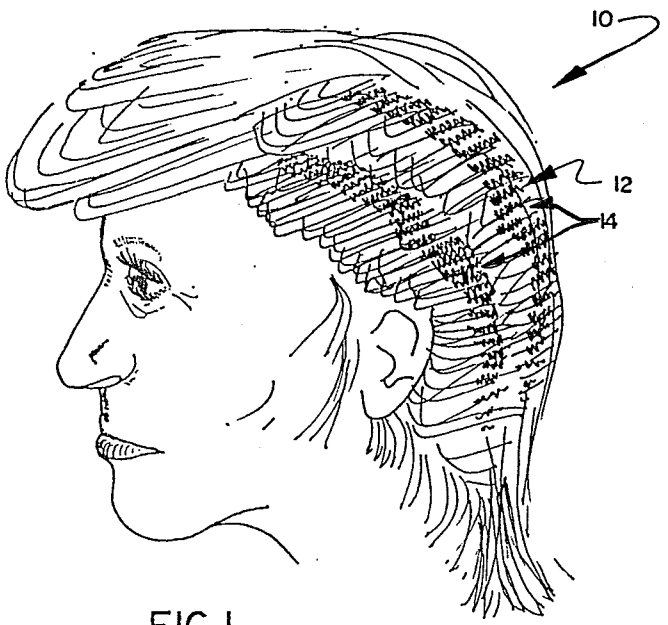
FIG. 1 is a somewhat schematicized illustration of a person having hair colored and cut by the method of the present invention.
Figure 5:
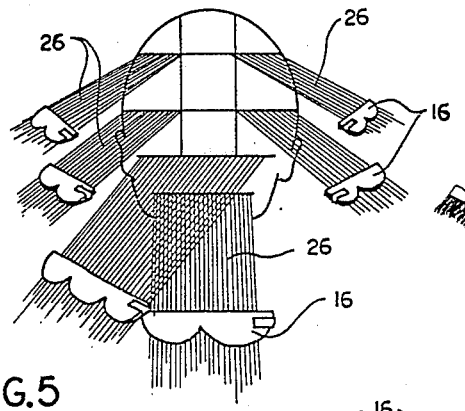
FIG. 5 is a schematic illustration of one way in which hair on the back of a head may be parted, colored and cut with the templet of FIGS. 2 and 3 to obtain a hair style similar to the one shown in FIG. 1.
Figure 6:
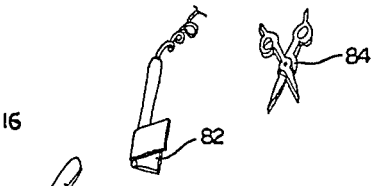
FIG. 6 is a schematic illustration, similar to FIG. 5, illustrating one way in which the hair on the side of the head may be parted and then colored and cut with the templet.
Figure 6:
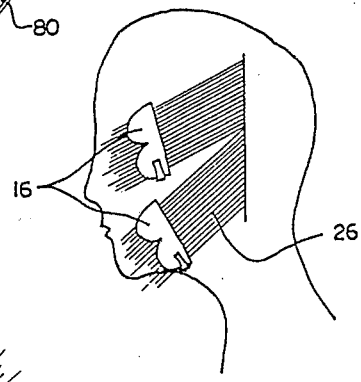
Figure 7:
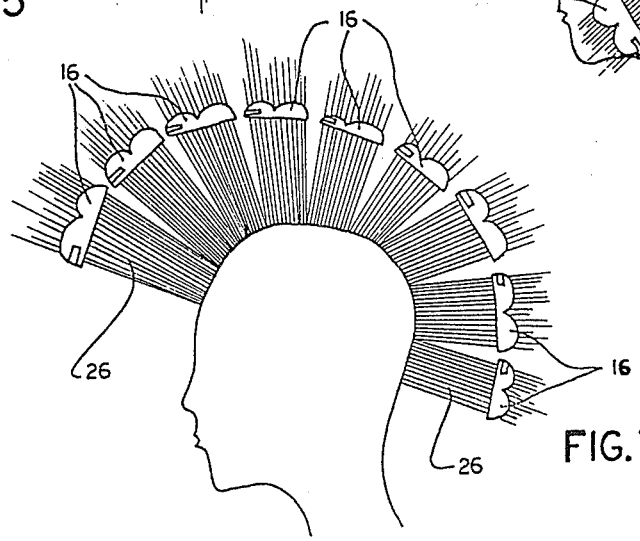
FIG. 7 is a schematic illustration, similar to FIGS. 5 and 6, illustrating one way in which the hairs on the center portion of the head may be parted and then colored and cut with the templet.

When hair is to be cut with the templet 16 to form the hairstyle of FIG. 1, the hair is first parted into sections in the general manner shown schematically in FIGS. 5, 6 and 7. Of course, the manner in which the hair is parted will depend upon the particular hairstyle in which the hair is to be colored and cut and the texture of the hair. The templet 16 can be used to color and cut many different hairstyles and it is not intended that the invention should be limited to the particular hairstyle shown herein.

Once the hair has been parted, the templet 16 is used to color and cut the back hair strands in the manner illustrated schematically in FIG. 7. Thus, the templet 16 is closed against a group of stands 26 of hair and moved outwardly away from the scalp and along the strands of hair to a selected position. A suitable coloring agent which either adds color to or removes color from the hair is then applied, with an applicator brush 80, to the portions of strands of hair extending outwardly from the pattern edged portions 34 and 36 of the templet 16. Of course, other types of applicators could be used to apply the coloring agent to the strands of hair.

In order to expedite the application of coloring to the hair, a heater 82 is used to heat the hair to which the coloring agent has been applied by the applicator 80. The heater 82 has a pair of panels which enclose the end portions of the strands of hair extending outwardly from the templet 16 and a portion of the templet. The heater 82 is then electrically energized to heat the portions of the strands of hair to quickly set or fix the color. Although many known types of heaters could be used, the heater 82 may advantageously be of the type sold by Sebastian Internationl Company of 6160 Variel Avenue, Woodland Hills, Calif. 91367.

After the coloring agent has been applied to the hair, the templet 16 is moved a short distance outwardly along the strands of hair. A cutting instrument, such as the scissors 84, is then used to cut the hair along the pattern edge portions 34 and 36 of the templet 16. The templet 16 maintains a continuous grip on the strands of hair from the time when it is first closed around the strands of hair, before coloring the hair, until after the hair has been cut.

After the hair has been colored and cut, the templet 16 is opened and the hair is released. At this time, the hair will have been cut to a nonlinear or scalloped pattern. The hair will also have been colored a uniform distance in from the cut end of each strand of hair. This results in the tips 14 of each strand of hair being colored for the same distance from the cut end of the hair. The resulting hairstyle has either highlights (light hair tips) or low lights (darkened hair tips) of a uniform length in a pattern which corresponds to the scalloped pattern to which the hair was cut.

The hair along the sides of the head (FIG. 6) is colored and cut next with the templet 16 in the same manner as previously explained in connection with FIG. 5. Finally, the hair in the central portion of the scalp is colored and cut using the templet 16 in the manner shown schematically in FIG. 7. The resulting hairstyle, which has been illustrated schematically in FIG. 1, has a controlled texture and movement of the hair. In addition, controlled highlights or lowlights are provided in the hair. The scalloped effect and the highlights or lowlights make fine hair appear fuller and bulky hair to be more movable.

Although the templet 16 has been described herein in connection with a coloring and cutting procedure in which the hair is colored and then cut to the same pattern, it is contemplated that the color could be applied to the hair with the templet 16 without cutting the hair to the same pattern. Thus, the templet 16 could be used for the application of a coloring agent to the hair with a brush 80. After heat has been applied to the hair with the iron 82, strands of hair could be cut along a straight line or left a natural length.

In view of the foregoing description, it is apparent that the present invention provides a new and improved method of coloring hair. In practicing the method, the hair 26 is gripped between a pair of panels 18 and 20 with a portion of the hair, to which a coloring agent is to be applied, extending outwardly from nonlinear edge portions 34 and 36 of the panels. A selected one of many known hair coloring agents is then applied to the portion of the hair extending outwardly from the edge portions 34 and 36 of the panels. The hair which is gripped between the panels 18 and 20 is not exposed to the coloring agent so that only the portion of the hair which extends outwardly from the panels 18 and 20 is colored.

Once the hair has been colored, the hair may be cut to a configuration corresponding to the configuration of the nonlinear edge portions 34 and 36 of the panels. When this is to be done, the panels 18 and 20 are moved outwardly along the hair for a selected distance indicated at 66 in FIG. 3. The hair is then cut along the nonlinear edge portions 34 and 36 of the panels to have a scalloped pattern or wave which gives the hair a controlled texture. The scalloped or patterned cut makes fine hair appear fuller and bulky hair more movable.

In order to reduce the time to color and cut the hair, heat is applied to the hair immediately after it is colored. Thus, while the hair is still gripped by the panels 18 and 20, heat is applied to the portion of the hair which extends beyond the nonlinear edge portions 34 and 36 of the panels and to which the coloring agent was applied. Heating the hair greatly reduces the time required for the coloring of the hair. The panels 18 and 20 can then be moved outwardly so that the hair can be cut in the manner previously explained.

Having described one specific preferred embodiment of the invention, the following is claimed:

1. A method of coloring hair, said method comprising the steps of providing a pair of panels having nonlinear edge portions with the same configuration, gripping the hair between the panels with the nonlinear edge portions of the panels in alignment and with a portion of the hair extending outwardly from the nonlinear edge portions of the panels, and applying a hair coloring agent to the portion of the hair extending outwardly from the nonlinear edge portions of the panels while continuing to grip the hair between the panels.

2. A method as set forth in claim 1 further including the step of applying heat to the portion of the hair extending outwardly from the nonlinear edge portions of the panels after performing said step of applying a hair coloring agent to the hair and while continuing to perform said step of gripping the hair between the panels.

3. A method as set forth in claim 1 wherein said step of applying a hair coloring agent to the hair includes the step of maintaining the portion of the hair between the panels substantially free of the hair coloring agent.

4. A method as set forth in claim 1 further including the step of cutting the hair along the nonlinear edge portions of the panels.

5. A method as set forth in claim 4 further including the step of applying heat to the hair after performing said step of applying a coloring agent to the hair and before performing said step of cutting the hair.

6. A method as set forth in claim 5 wherein said step of gripping the hair between the panels is continuously performed from a time prior to performing said step of applying a coloring agent to the hair until completion of said step of cutting the hair.

7. A method as set forth in claim 1 further including the step of decreasing the extent to which the hair extends outwardly from the nonlinear edge portions of the panels by sliding the panels along the hair, and, after decreasing the extent to which the hair extends outwardly from the nonlinear edge portions of the panels, cutting the hair along the nonlinear edge portions of the panels.

8. A method as set forth in claim 1 wherein said step of gripping the hair between the panels includes the step of holding the hair against sidewise movement by engaging the hair with a plurality of bristles disposed between the panels.

* * * * *